US006837839B2

(12) United States Patent
Payne et al.

(10) Patent No.: US 6,837,839 B2
(45) Date of Patent: Jan. 4, 2005

(54) UV TONER FUSING

(75) Inventors: David M. Payne, Star, ID (US); Richard L. Payne, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/672,616

(22) Filed: Sep. 25, 2003

(65) Prior Publication Data

US 2004/0057757 A1 Mar. 25, 2004

Related U.S. Application Data

(62) Division of application No. 09/992,886, filed on Nov. 6, 2001, now Pat. No. 6,653,041.

(51) Int. Cl.[7] ..... F28F 5/02

(52) U.S. Cl. ..... 492/46; 399/320; 399/335

(58) Field of Search ..... 492/46; 399/320, 399/335

(56) References Cited

U.S. PATENT DOCUMENTS 4,088,552 A * 5/1978 Morrison et al. ..... 204/157.44
4,380,794 A * 4/1983 Lawson ..... 362/296
5,888,689 A * 3/1999 De Meutter et al. ..... 430/124
6,194,127 B1 * 2/2001 Stolk et al. ..... 430/313

* cited by examiner

*Primary Examiner*—Mark A. Chapman

(57) ABSTRACT

A method and apparatus for fusing toner to a laser printed page. The apparatus includes a photosensitive drum, a laser optic system for tracing an image on the photosensitive drum, a toner supply electrically charged opposite the image traced on the photosensitive drum, and an ultraviolet light source for imparting energy to the toner to fuse the toner to the page. The apparatus facilitates faster print speeds and lower energy consumption than conventional laser printers that require heating elements to fuse the toner to the page.

15 Claims, 4 Drawing Sheets

UV TONER FUSING

CROSS REFERENCE TO RELATED APPLICATION

This is a divisional of application Ser. No. 09/992,886 filed on Nov. 6, 2001, now U.S. Pat. No. 6,653,041 which is hereby incorporated by reference herein.

FIELD

The present invention relates to printing, and more particularly to the process of fusing toner to paper.

BACKGROUND

Modem laser printing is generally accomplished by what is commonly known as the electrophotographic process. At the heart of the imaging process is an organic photoconductive (OPC) drum, and the drum typically includes an extruded aluminum cylinder coated with a non-toxic organic photoconductive material. There are six generalized stages to the electrophotography process: cleaning, conditioning, writing, developing, transferring and fixing.

Cleaning is the first stage in the imaging process. This stage prepares the OPC drum to receive a new latent image by applying a physical and electrical cleaning process. The physical cleaning of the OPC is typically accomplished by a drum-cleaning blade (or wiper blade) and a recovery blade. The wiper blade scrapes any excess toner from the drum and the recovery blade catches the toner and sweeps it into a waste hopper. In the electrical aspect of cleaning, the previous image on the drum must be cleared before a new one may be applied. The electrical cleaning of the OPC drum is performed by erasure lamps (usually corona wire technology) or a primary charge roller (PCR), which eliminate the previous latent image from the drum.

After the drum has been cleaned, it must be conditioned or charged to accept the image from the laser. A primary corotron (corona wire or PCR) applies a uniform negative charge (usually in the range of −600V to −720 V DC) to the surface of the drum.

Following the conditioning stage is the writing stage. According to this stage, a laser beam is used to discharge a conditioned charge to the drum surface. The conditioned charge creates a latent image on the drum. An aluminum base is connected to an electrical ground and the photoconductive material comprising the OPC becomes electrically conductive to ground when exposed to light (generally a laser). Therefore, the negative charges deposited onto the surface of the drum conduct to the aluminum base when exposed to light, creating the latent image. The latent image area will attract toner in a later stage.

The fourth stage is developing. At this stage, the latent image becomes a visible image. This stage generally requires four major components: toner, a developer roller assembly, a metering blade, and an AC/DC charge. Toner is attracted to the developer roller either by an internal magnet or by an electro-static charge. The roller carries the toner particles to a metering blade (a/k/a a doctor blade), where toner tumbles and creates a tribo-electric charge (friction) on the surface of the toner particles. The metering blade then provides for an evenly distributed amount of toner to pass to the OPC drum. Once the toner particle has passed beyond the doctor blade, it is ready to be presented to the OPC drum. The developer roller is then charged with an AC/DC charge from the High Voltage Power Supply. This charge allows the toner particles to "jump" from the developer roller and travel to the OPC drum where it is attracted to the latent image.

At this point, the toner image on the drum is transferred onto a sheet of paper. As the paper is passed under the OPC drum, it is passing over a transfer corotron assembly. The transfer corotron assembly places a positive charge on the back of the page, thus attracting the toner from the drum.

The sixth and final stage is fixing. Also known as fusing, this is the stage in which toner is permanently affixed to the paper. The fuser assembly typically includes a heated roller, a pressure roller, a heating element, a thermistor, a thermal fuse, and, sometimes, a cleaning pad. The heating element is typically placed inside the heated roller, which is usually constructed of aluminum with a Teflon coating. The roller is heated to approximately 355° F. (180° C.). The second roller is usually a rigid foamed silicon rubber. This second roller applies pressure to the heated roller. The paper passes between the two rollers and the heated roller melts the toner particles while the pressure roller presses the toner into the fiber weave of the paper.

As laser-printing technology has evolved, one of the primary focal points is the printing speed. There is a constant demand for higher print speeds. However, as print speed increases, the power required for the fixing or fusing stage becomes greater, as the toner requires a certain amount of energy to melt and fuse to the paper. Current fusing technology has thus come to a speed "ceiling," where faster print speeds may require printers to have dedicated thirty-amp circuits to provide the necessary power to the heating element to keep up with the high print speeds. As speed demands continue to rise, the availability and feasibility of heating element power requirements to fuse the toner has become prohibitive. In addition, it has been a constant problem to apply an even heating distribution to the roller and the toner, leading to poorly fused images.

Further, during times when the printer is not in use, generally the user prefers that the printer, and especially the high energy absorbing heating element, revert to a low power or "sleep" mode. However, when the user does have a need to print either while the printer is in sleep mode or when the printer has been turned off completely, it generally takes significant time for the heating element to warm up before the printer is operational. In addition, the use of heating elements introduces other deleterious effects, usually necessitating the use of cooling apparatus to keep components that may be heat sensitive from overheating. Often the use of fans is necessary—adding again to the power requirements.

U.S. Pat. No. 5,212,526 ('526) discusses an alternative to the conventional fusing by introducing an apparatus for simultaneously transferring and fusing a toner solute in a UV-curable solution. That is, the transferring and fusing of the toner solute is accomplished at the same time. However, the apparatus taught by the '526 patent utilizes a large belt to advance the page, and this large belt is very specialized and expensive. The large belt taught by the '526 patent must be a photoreceptor and also be capable of transmitting UV rays—capabilities that at present are very expensive. Further, the '526 patent depends on intimate contact between the paper and the photoreceptor to simultaneously transfer and fuse the image to the page. In fact, the transfer of the image from the photoreceptor to the paper is dependant on greater adhesion of the toner image to the paper than to the photoreceptor. With the wide variety of papers, finishes, and toners presently used, it is a very difficult proposition, at best, to ensure acceptable print quality by creating greater adhesion to the paper than the photoreceptor. The problems with simultaneous transferring and fusing of the toner according to the '526 patent are further exacerbated by the need to partially pre-cure the toner solute with an air knife to attempt to facilitate adherence of the toner solute to the paper. The air knife adds additional expense and apparatus to a printer.

U.S. Pat. No. 5,232,812 ('812) discloses another alternate process for forming an image. However, the process disclosed by the '812 patent involves applying a separate layer of UV-curable liquid over the toner and does suspend the toner particles in the UV-curable liquid.

SUMMARY

In accordance with one aspect of the invention, there is disclosed a printing apparatus including a print medium transport system, a translucent roller, and an ultraviolet light source for curing an image on a print medium. There may also be included a photosensitive drum, a laser optic system for tracing an image on the photosensitive drum, a UV curable toner supply electrically charged opposite of the image traced on the photosensitive drum, and the translucent roller having an ultraviolet light source disposed therein. The apparatus may further include a pressure roller arranged adjacent to the translucent roller for imparting pressure to a page passing between the translucent roller and the pressure roller. The translucent roller may include borosilicate glass.

According to another aspect of the present invention, there is disclosed a toner fusing apparatus including a translucent roller in a laser printer with an ultraviolet light source disposed therein and a pressure roller arranged adjacent to the translucent roller for imparting pressure to a toner-bearing page passing therebetween.

According to one aspect of the present invention there is disclosed method of printing an image on a page by the electrophotography process, the process including the steps of cleaning an organic photoconductive (OPC) drum, conditioning the OPC drum to accept an image from a laser, writing a latent image on the drum with a laser beam, developing the latent image into a toner image by attracting toner to the OPC drum, transferring the toner to the page, and separately fusing the toner to the page by applying UV light to the toner.

According to one aspect of the present invention there is disclosed a method of fusing an image to a page, the method including the steps of transferring toner from a photoconductive drum of a laser printer to a page, and separately fusing the toner to the page by the application of UV light to the toner. This method may be accomplished by a conventional laser printing apparatus with the addition of a UV fusing station, however the conventional laser printing apparatus may not include a heating element.

According to another aspect of the invention there is disclosed a borosilicate cylinder comprising a UV light source therein. The borosilicate roller may further include a UV translucent, compliant elastomer coating disposed on the borosilcate cylinder for enhancing gloss fusing. This coating may include silicon rubber or other coatings that are UV translucent, compliant, and optionally able to withstand relatively high temperatures.

According to another aspect of the invention there is disclosed a chemical compound including an ultraviolet light curable resin, toner particles suspended in the resin, and a charge director added to the resin. The suspension of the particles may be facilitated by a surfactant, for example by Nonoxinal™. The compound may further include another additive such as a charge director, to facilitate the acceptance of an electric charge by the compound. The charge director may be quaternary ammonium salts.

BRIEF DESCRIPTION OF THE DRAWINGS

The foregoing and other features and aspects of the invention will become further apparent upon reading the following detailed description and upon reference to the drawings in which.

Figure 1:
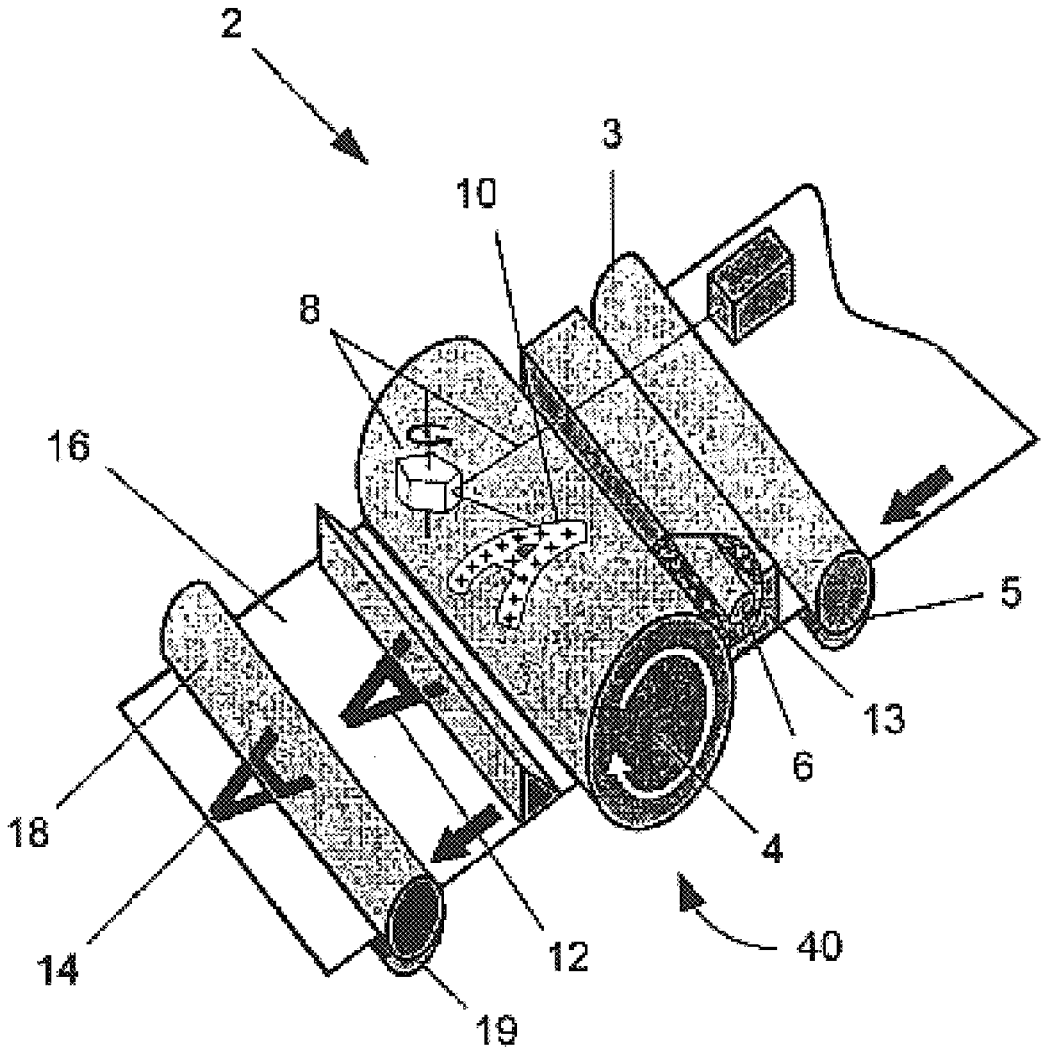
FIG. 1 is a laser printing apparatus according to one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF PREFERRED EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Turning now to the drawings, and in particular to FIG. 1, one embodiment of a laser printing apparatus (2) according to the present invention is shown. Laser printing apparatus (2) may include one or more photosensitive drums, for example organic photoconductive drum (4). Photoconductive drum (4) is readily available from a variety of commercial sources. Laser printing apparatus (2) may also include a charging member, for example a corona wire (not shown), for applying a negative charge to photoconductive drum (4). Laser printing apparatus (2) may further include a laser optic system (8). Laser optic system (8) may be used to write a latent image (10) on photoconductive drum (4). As described in the background section of this disclosure, latent image (10) may be developed by attracting toner (12) to photoconductive drum (4). Toner (12) may be positively charged by a charge roller (6). Toner (12) may be specially configured as discussed below. Laser printing apparatus (2) may also include a print medium transport system, for example rollers (3) and (5), for conveying paper (16) through the printing apparatus.

Developed image (14) may be transferred to a print medium or page, for example paper (16), by a toner transfer system (40). In the embodiment shown, toner transfer system (40) includes photoconductive drum (4) and a charge medium, for example a corotron wire (not shown), which places a positive charge on the back of paper (16), thus attracting the toner from the drum. In some embodiments, transfer of the toner to the paper may occur without intimate contact between photoconductive drum (4) and paper (16). In addition, it will be understood by those of skill in the art with the benefit of this disclosure that the print medium or page may be a transparency, slide, cardstock, construction paper, vinyl, or other page, and not limited to paper. Toner (12), which is arranged as developed image (14), may then be fused to paper (16) by the application of ultraviolet (UV) light transmitted from a UV light source, for example first and second rollers (18) and/or (19). Rollers (18) and (19) may comprise a UV light emitting "station" separate and distinct from transfer system (40).

It will be understood that in some embodiments there may be only a first light source, in the present embodiment comprising roller (18). The details of the UV light source will be discussed below. UV light will be defined as all electromagnetic radiation with wavelengths in the range of ten to four hundred nanometers, or frequencies from 7.5E14 to 3E16 Hz. UV light sources are readily available from a myriad of sources, as are UV curable liquids or resins. Toner (12) may be specially formulated with a UV curable liquid to facilitate curing and/or fusing of toner (12) to paper (16). For example toner (12) may include toner particles suspended in a UV curable resin.

The suspension of the toner particles in the UV curable resin may be advantageously facilitated by the addition of one or more additives. A surfactant, for example Nonoxinal™, may be added to the UV curable resin. The surfactant prevents the toner particles from settling, separating, gathering, etc. to ensure quality printing. In addition, a charge director, for example quaternary ammonium salts, may be added to the UV curable resin and toner particles. Charge directors enable compounds such as the toner suspension UV curable resin to hold an electrical charge. By employing a toner-suspended UV curable resin that is capable of accepting an electric charge, an image on photoreceptor (4) comprising the toner/resin may be transferred from the photoreceptor to paper (16), in some embodiments even without contact between the paper and the photoreceptor. The image may "jump" a gap between the photoreceptor and the paper if desired, or there may be contact between the paper and photoreceptor in some embodiments. By creating a toner-suspended UV curable solution capable of accepting an electric charge, wear to the photoreceptor may advantageously be reduced as little or no cleaning of the photoreceptor by a doctor blade or other cleaning apparatus may be necessary.

In a conventional laser printing apparatus, the fusing rollers comprise a heating and pressure element to melt toner (12) and fuse the toner to paper (16). However, according to the present embodiment of the invention disclosed in FIG. 1, at least one of the rollers (18 and 19) advantageously comprises a UV light source, which may be used without a heating element. Thus, the present invention enables the elimination the heating element in favor of UV light sources (18) and (19)—and therefore the problems associated with warm up times, high-current requirements, and cooling equipment are also reduced or eliminated. For example, there may be no need for cooling fans—which may be quite noisy. Rollers (18) and (19) do not require warm up time to operate and may function with much less energy than a heating element. At least roller (18) (and in some cases roller (19) as well) emit UV light to toner (12) and thus cure and fuse toner (12) to page (16). In the embodiment of FIG. 1, rollers (18) and (19) are arranged to impart pressure to toner (12) and paper (16) substantially concurrently with the application of UV light as the paper passes through the rollers to facilitate the fusion of toner (12) into the fiber weave of page (16). As will be discussed below, the fusion of toner (12) to page (16) may not require the pressure roller arrangement of rollers (18) and (19). The application of UV light energy by at least roller (18) may advantageously be uniformly applied to paper (16) without the problems of uneven distribution associated with heating elements.

Figure 2:
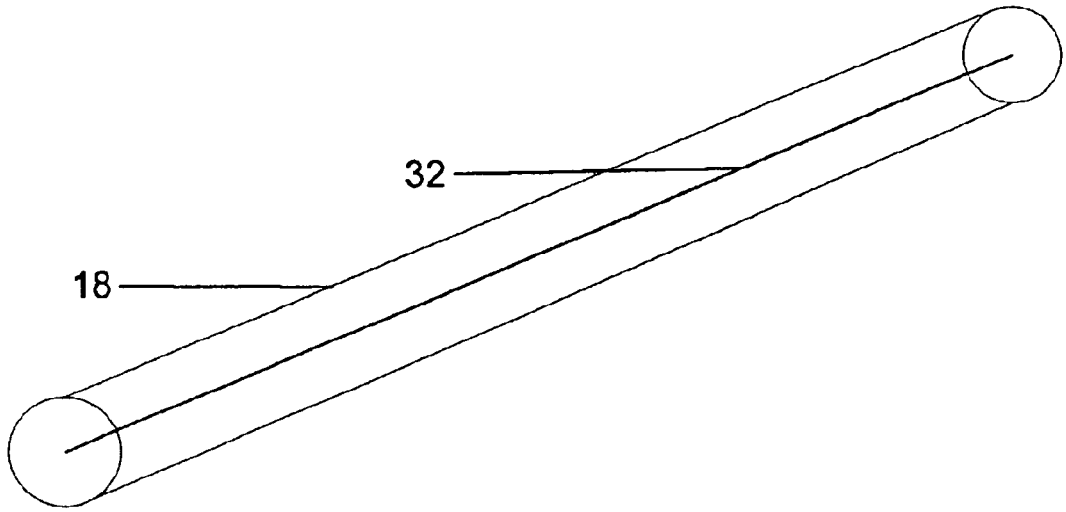
FIG. 2 is a perspective view of a UV roller according to one embodiment of the present invention.
Figure 3:
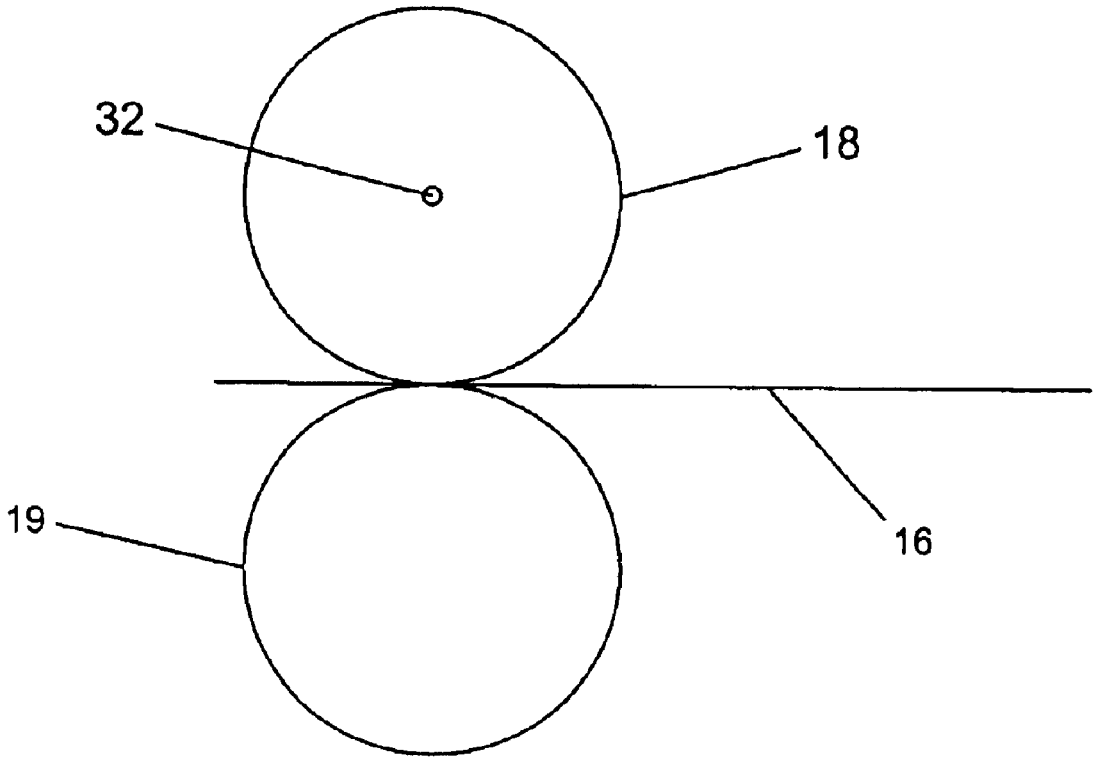
FIG. 3 is a side view of the UV roller shown in FIG. 3.

As shown in FIGS. 2–3, the UV light source may be a translucent roller, for example roller (18) may be a borosilicate (Pyrex™) roller. According to this embodiment, a traditional roller with a heating element therein—as are commonly used in a typical laser printer—may be replaced with borosilicate roller (18). Borosilicate roller (18) may include a filament (32) or other source for providing the UV light used to cure and/or fuse toner to page (16). In the embodiment shown, filament (32) is internal to borosilicate roller (18), but this is not necessarily so. A UV light source external to borosilicate roller (18) may be used, with the UV light passing through the roller. Borosilicate roller (18) may also contact page (16) to apply pressure to the toner. Second roller (19) may be a conventional roller or it may also be a borosilicate roller. Advantageously, there is very little modification necessary to a conventional laser printer, and the toner may be simultaneously cured and pressure treated by borosilicate roller (or rollers) (18) and (19). Further, the embodiment of FIGS. 1–3 advantageously provides for fusing of the toner image to the page separately from the transfer of the image to the page. Borosilicate roller (18) and roller (19) (whether borosilicate or not) may replace the conventional heated rollers to provide for curing of, for example, the toners suspended in UV curable resins discussed above. However, borosilicate roller (18) and roller (19) may be added to (instead of replacing) conventional rollers in a printing apparatus as a separate "station". Borosilicate roller (18) may further include a UV translucent, compliant elastomer coating disposed on the borosilcate cylinder for enhancing gloss fusing. This coating may include silicon rubber or other coatings that are UV translucent, compliant, and optionally able to withstand relatively high temperatures.

Figure 4:
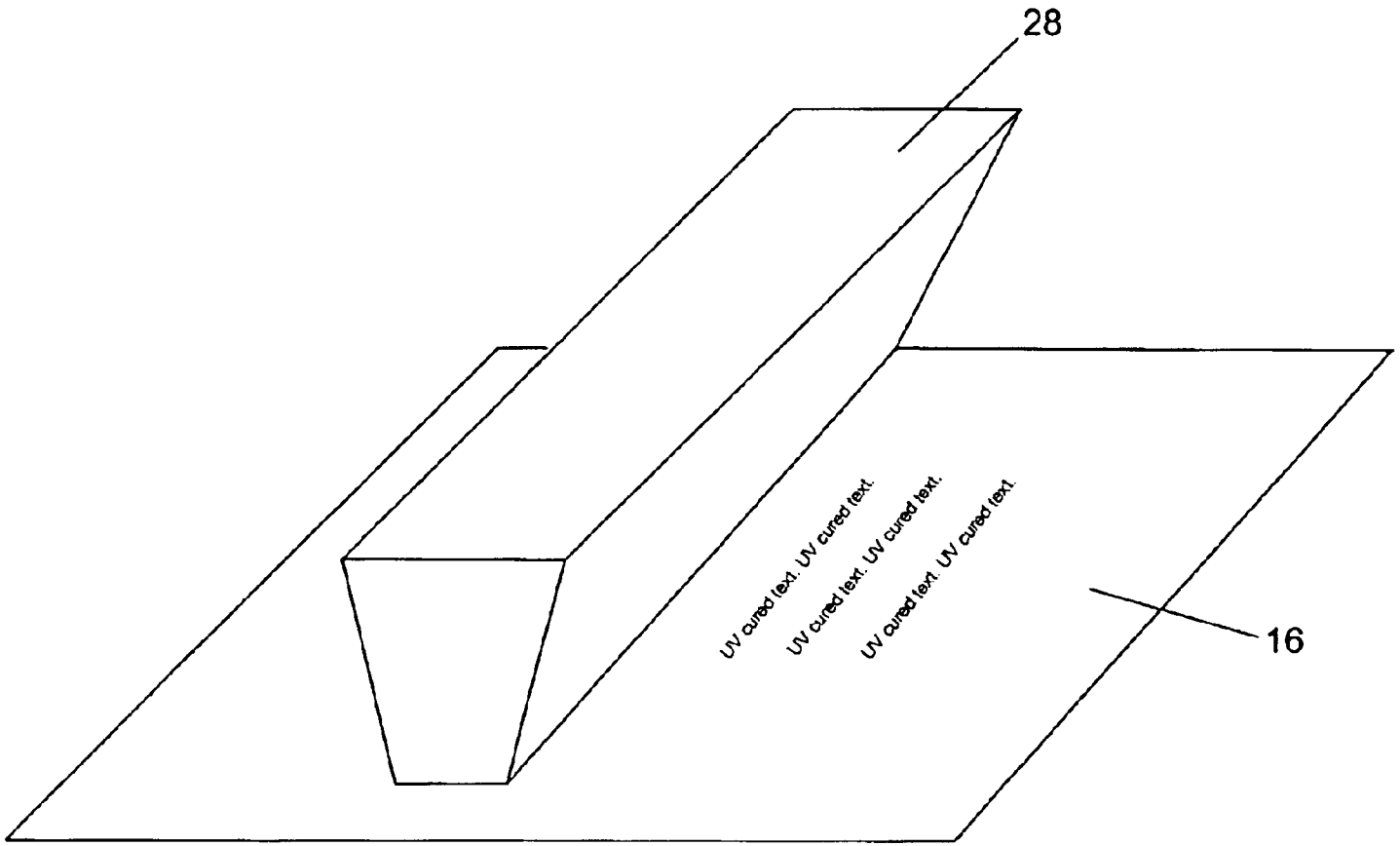
FIG. 4 is perspective view of a UV fusing apparatus according to one embodiment of the present invention.

Referring next to FIG. 4, an alternative embodiment for fusing toner to a print medium is disclosed. According to the embodiment of FIG. 4, in place of rollers (18) and (19) shown in FIG. 1, there is UV light source (28). This alternative embodiment exemplifies that the UV light source (28) may be shaped in any convenient arrangement to cast UV light onto page (16). As UV sensitive toner, such as the toner particles suspended in a UV curable resin as discussed above, passes by UV light source (28), the UV sensitive toner is cured and fused to page (16). While other printing apparatuses may have disclosed simultaneously transferring an image to a page and UV curing the toner, the present invention contemplates, with regard to UV fusing, separately transferring an image to a page and curing the toner. The separate UV curing step advantageously facilitates the use of mostly-conventional laser printing apparatus, with the addition of a UV curing station (such as UV light source (28)) to either replace the traditional heating element/pressure roller arrangement altogether, or to be used in combination with the traditional pressure rollers, i.e. pressure rollers may be included or excluded according to need and desire with the addition of a UV curing station of the present invention. According to the present invention, there is no need for a specialized photosensitive belt as with prior UV cured printing apparatuses. Toners suspended in a UV curable resin require much less energy to fuse to a page than the traditional heat-fused toners, and the need for cooling systems including noise-adding fans may also be eliminated. Therefore, a laser printer may employing the present invention with UV cured images may be operated at reduced power and/or at higher print speeds. According this embodiment of the present invention, there may or may not be contact between page (16) and any fusion-enhancing rollers. If a user desires to use a UV curing station with traditional heated rollers (preferably after disconnecting power to the heating element to conserve energy—but not necessarily so) or with rollers with no heating elements, there will be pressure-roller contact with the paper. However, in some embodiments there may be no rollers at all to facilitate toner fusing, instead the toner may be fused only by the application of UV light from source (28), which may be spaced from paper (16). The UV light (28) source may be added to a conventional laser printing apparatus, and/or the UV light source may be arranged before or after engagement of the paper with the pressure rollers.

According to one embodiment of the present invention, there may be a gap between photoreceptor (4) and paper (16). The toner suspended in a UV curable resin may transfer from photoreceptor to paper without contact therebetween. This may be accomplished by applying a charge to the UV curable resin containing toner in suspension as discussed above. The gap between photoreceptor (4) and paper (16) advantageously reduces wear on the photoreceptor during the cleaning stage and allows transfer of an image to paper (16) without reliance on greater adhesion of the toner suspended in UV curable resin to the paper (or other medium) than to the photoreceptor.

It will be understood by those of skill in the art having the benefit of this disclosure, that the toners suspended in UV curable resins as described herein may also be used in other printing processes. For example, toners suspended in UV curable resins may be used in the liquid electro-photography (LEP) process to provide a UV curable toner capable being fused and/or cured by the application of UV light, and also capable of accepting a charge, if necessary.

While the present invention has been particularly shown and described with reference to particular illustrative embodiments thereof, it will be understood by those skilled in the art that various changes in form and details may be made without departing from the spirit and scope of the invention. The above-described embodiments are intended to be merely illustrative, and should not be considered as limiting the scope of the present invention.

What is claimed is:

1. A roller configured for use in a printer, said roller comprising a borosilicate cylinder comprising a UV light source therein.

2. The roller of claim 1, further comprising a laser printer configured to accept said roller as part of a print medium transport system.

3. The roller of claim 1, further comprising a UV translucent, compliant elastomer coating disposed on the borosilcate cylinder.

4. The roller of claim 3, wherein said coating comprises silicon rubber.

5. The roller of claim 1, wherein said roller has a length equal to or greater than a width of a print medium used in said printer.

6. The roller of claim 1, wherein said roller is configured to contact and apply pressure to a print medium used in said printer.

7. A laser printer comprising:

a roller comprising a borosilicate cylinder comprising a UV light source disposed therein for rolling over a print medium and curing toner deposited on said print medium by said laser printer.

8. The printer of claim 7, further comprising a supply of toner, said toner comprising:

an ultraviolet light curable resin;

toner particles suspended in the resin; and a charge director.

9. The printer of claim 8, further comprising a surfactant to facilitate the suspension of the toner particles in the resin.

10. The printer of claim 9, wherein the surfactant comprises nonoxinal.

11. The printer of claim 8, wherein the charge director comprises quaternary ammonium salts.

12. The printer of claim 7, further comprising a UV translucent, compliant elastomer coating disposed on the borosilcate cylinder.

13. The printer of claim 12, wherein said coating comprises silicon rubber.

14. The printer of claim 7, wherein said roller has a length equal to or greater than a width of said print medium used in said printer.

15. The printer of claim 7, wherein said roller is configured to contact and apply pressure to a print medium used in said printer.

* * * * *